United States Patent [19]

Merchant

[11] Patent Number: 4,695,686

[45] Date of Patent: Sep. 22, 1987

[54] VALVE SUPERVISORY SWITCH

[75] Inventor: David E. Merchant, Lincoln, Nebr.

[73] Assignee: Emhart Industries Inc., Indianapolis, Ind.

[21] Appl. No.: 906,992

[22] Filed: Sep. 15, 1986

[51] Int. Cl.[4] ..... H01H 9/06

[52] U.S. Cl. ..... 200/61.86

[58] Field of Search ..... 200/61.41, 61.42, 61.86, 200/153 T, 302.1, 302.3, 332, 294

[56] References Cited

U.S. PATENT DOCUMENTS

| | | | |
|---|---|---|---|
| 2,573,139 | 10/1951 | Hoffman | 200/61.41 |
| 2,801,308 | 7/1957 | Cubellis | 200/61.41 |
| 3,189,700 | 6/1965 | Eidson | 200/61.86 |
| 4,002,872 | 1/1977 | Desio | 200/294 |
| 4,342,886 | 8/1982 | Demi | 200/61.86 |

FOREIGN PATENT DOCUMENTS

| | | | |
|---|---|---|---|
| 2098399A | 11/1982 | United Kingdom | 200/332 |

*Primary Examiner*—J. R. Scott

*Attorney, Agent, or Firm*—Robert F. Meyer; Carl A. Forest

[57] ABSTRACT

A switch is mounted on a plate within a housing having a housing body with a port and a removable housing cover. A switch actuator rod is mounted on a pivot within a sleeve that may be coupled to the housing so that the rod extends through the port and engages the switch within the housing. A linear actuator rod is slideably mounted within a sleeve which also may be coupled to the housing so that the rod extends through the port and engages the switch. A spring is mounted on the housing cover in a direction traverse to the arc through which the swing actuator rod pivots so that it engages the end of rod and biases it away from the switch. By removing the cover, moving the rod to the opposite end of its arc, and replacing the cover, the direction of engagement of the rod with the spring may be changed. The switch plate is movable along the rod's arc of pivot so that the switch trip point along the arc may be adjusted.

8 Claims, 18 Drawing Figures

VALVE SUPERVISORY SWITCH

BACKGROUND OF THE INVENTION

1. Field of the Invention

The invention in general relates to valve supervisory switches, and more particularly to a supervisory switch that is easily adapted to provide effective supervision in a wide variety of valve monitoring situations.

2. Description of the Prior Art

Valve supervisory switches are commonly used to monitor the position of the valves in fire extinguishing sprinkler systems. Two types of supervisory switches are known in the art: a linearly activated (slide) type switch and a swing activated (pivot) type switch. Generally the linearly activated switch is used to monitor the movement of the valve stem in a conventional screw-type valve (see below). Generally the swing activated switch is used to monitor a post indicator valve (see below). It would be highly desirable to have a single supervisory switch that could be easily adapted to either the linearly activated or swing activated configuration. This would not only result in a savings in inventory of two different switches, but also would allow adjustments to be readily made in the field in the case of error or other situations in which a different type of valve is encountered than was anticipated.

The post indicator valve may be either of the flag rising or flag falling variety. Prior art supervisory switches must be inverted to adapt them from the flag rising variety to the flag falling valve variety. This requires that the wiring ductwork be located differently in the two situations. It would be desirable if the valve could be adapted easily for both the flag rising and flag falling variety of valves which would permit the ductwork to be installed the same in both instances.

In addition, fire sprinkler valves vary considerably from one manufacturer or model to the next, and the particular environment of a valve in the field may required different placement of the supervisory valve and/or its associated ductwork and wiring. Thus it would be highly desirable to have a valve that is readily adjustable to a wide variety of field situations.

SUMMARY OF THE INVENTION

It is an object of the present invention to provide a valve supervisory switch that can be adapted to a wide variety of field situations with a minimum of effort and parts.

It is another object of the invention to provide a valve supervisory switch that can be configured in either a linearly actuated or swing actuated mode.

It is a further object of the invention to provide a valve supervisory switch that can be easily adapted in the field for either the flag rising or flag falling variety of post indicator valves with the same ductwork in either situation.

It is a further object of the invention to provide a valve supervisory switch that is reliable and inexpensive to manufacture.

The invention provides a supervisory switch comprising a housing having a port; a switch within the housing; a swing actuator member, a pivot means for pivotably supporting the swing actuator member; a linear actuator member and a means for supporting the linear actuator member while permitting it to move linearly; coupling means for permitting coupling of the swing actuator member to the housing with the swing actuator member extending through the port and engagable with the switch and for permitting coupling of the linear actuator member tot he housing with the linear actuator member extending through the port and engagable with the switch; and means for attaching the housing to a valve assembly with one of the actuator members engaging a movable portion of the valve assembly. Preferably the swing actuator member comprises a rod pivotable about an arc about the pivot means, the housing comprises a housing body and cover and the supervisory switch further includes a resilient means attached to the cover and intersecting the arc of the rod. In another aspect the invention comprises a switch; a resilient member; a swing actuator member, a pivot means for pivotably supporting the swing actuator member so that it trips the switch alng the arc throug which it pivots and engages the redsilient member; means for changing the direction along the arc in which the swing actuator member engages the resilient member; and means for attaching the switch, the resilient member, the swing actuator member, and the pivot means to a valve assembly with the actuator member engaging a movable portion of the valve assembly. Numerous other features, objects and advantages of the invention will become apparent from the following detailed description when read in conjunction with the accompanying drawings.

BRIEF DESCRIPTON OF THE DRAWINGS

DESCRIPTION OF THE PREFERRED EMBODIMENT

Figure 1:
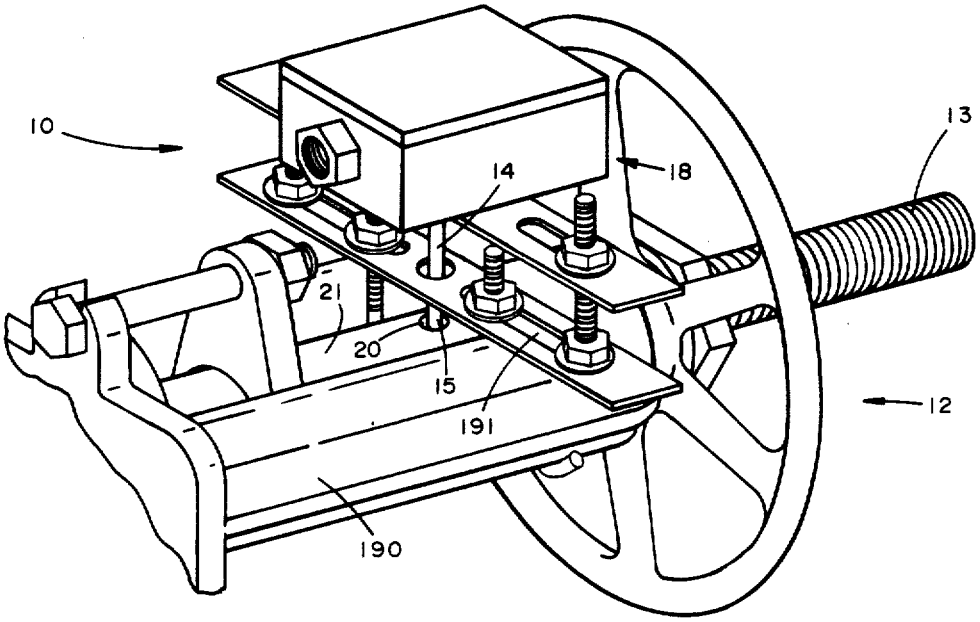
FIG. 1 is a perspective view of the supervisory switch according to the inventin configured in the linearly actuated mode and attached to a fire sprinkler valve.
Figure 3:
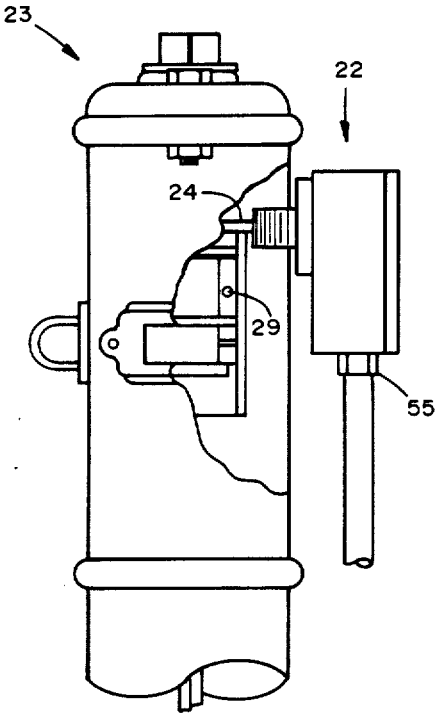
FIG. 3 is a side elevational partially cut away view of a supervisory switch according to the invention configured in the swing actuated mode and attached to a post indicator valve of the flag falling variety.
Figure 4:
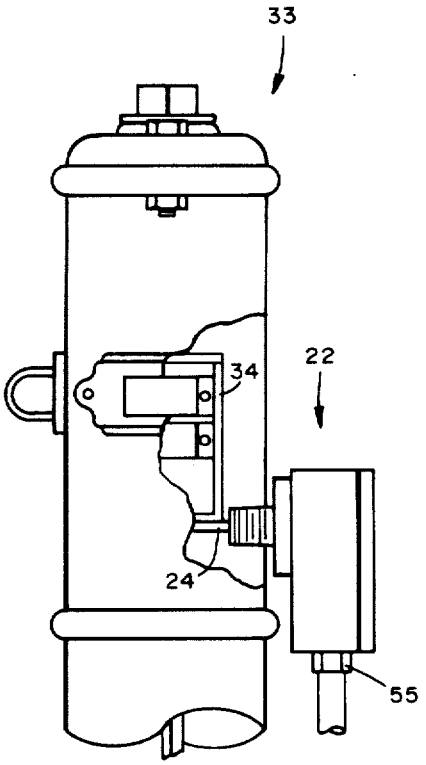
FIG. 4 is a side elevational partially cut away view of the switch of FIG. 3 attached to a post indicator valve of the flag rising variety.
Figure 5:
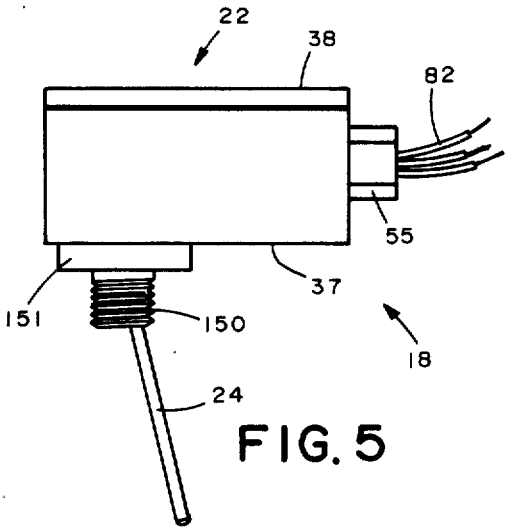
FIG. 5 is a side view of the switch according to the invention in the swing actuated configuration.
Figure 6:
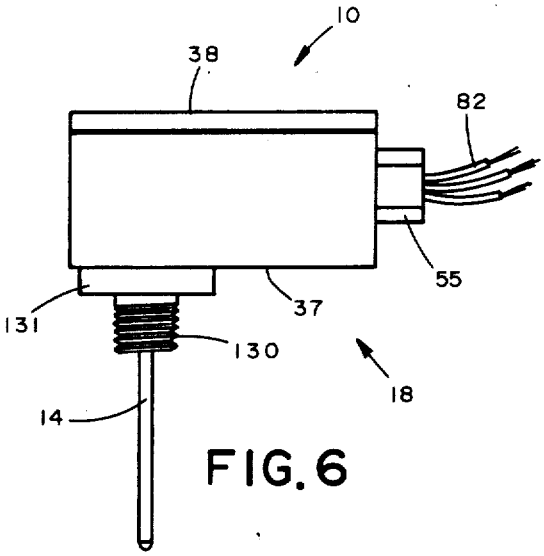
FIG. 6 is a side view of the switch according to the invention in the linearly actuated configuration.

Directing attention to FIG. 1, the supervisory switch 10 according to the preferred embodiment of the invention is shown mounted on an valve assembly 12 of a fire sprinkler system. The switch 10 in FIG. 1 is configured in the linearly actuated mode, which means that the actuator member 14 moves linearly to actuate microswitches 16 and 17, noting FIGS. 9-11, within housing 18 of the switch 10. As can be best seen in FIG. 11, the distal end 15 of actuator member 14 seats in a detent 20 drilled in valve stem 21 and as the valve stem moves in or out as the valve is opened or closed the actuator 14 moves linearly in a direction into the switch housing 18 to depress plungers 26 and 27 to actuate microswitches 16 and 17. In FIG. 3 the supervisory switch 22 according to the preferred embodiment of the inventio is shown mounted on a fire sprinkler system post indicating valve 23. The switch 22 in FIG. 3 is configured in the swing actuated mode, which means that the actuatormember 24 swings to actuate microswitch 16 and 17 shown in FIGS. 7, 8 and 12. In FIG. 3 when the valve 23 is turned the flag 29 falls and spring 30 pulls the proximal end 31 of actuation member 24 away from the normal position betwen microswitch plungers 26 and 27 and the plungers extend to actuate the switches 16 and 17. The operation of the switch 22 and post indicating valve 33 of FIG. 4 is similar to that just described for FIG. 3 except that in this case the flag 34 rises.

Turning now to a detailed description of the supervisory switch 10 and 22 according to the invention and referring to FIGS. 7 through 14, switches 10, 22 include a housing 18 in the form of a rectangular box. Housing 18 includes a body portion 37 and a cover portion 38. Body portion 37 is a hollow rectangular box of exterior dimension approximately 4 inches×3 inches×1.5 inches with a wall thickness of about 0.125 inches and having one open side. Partly cylindrical lands such as 40 are molded into each corner with a threaded hole, such as 41, bored about 1 inch into each land. Circular port 52 is formed through back wall 50 at a point about 1.109 inches fromone end of housing body 37 and centered over the center line of the long dimension. Arms 44 and 45 about ⅜ inches thick and ½ inches high are molded adjacent each side of walls 47 and 48 of housing body 37 near the end of which port 52 is located. Four threaded holes, such as 51, are tapped intot he back 50 of housing body 37 into each of four bosses 43 formed in housing body 37. Threaded bores such as 53 are formed in each of arms 44 and 45. Two bosses 54A are formed in housing body 37, in which bosses circular detents 54 about 0.25 inches in diameter and 0.1 inches deep are formed in the back 50 of housing body 37 to receive locating bosses of a coupling as discussed below. A hexagonal neck 55 about 1 inch in outside diameter is formed at one end of housing body 37 extending about 0.417 inches outside the end wall. A flange 56 having an upper portion 57 and a lower portion 58 is molded in the housing body 37 just interiorly of neck 55. The lower portion 58 extends about 0.667 inches into the housing while the upper portion extends only about 0.417 inches. A 0.5 inch threaded bore 60 is formed through neck 55 to the end of the upper portion 57 of the flange 56. A semicircular bore 61 about 0.237 inches in radius is formed in lower portion 58 of the inner flange 56. Microswitches 16 and 17 are mounted on housing body 37 by means of a roughly W-shaped plate 64, having outer wings 65 and 66 and a central open ended slot 67 about 0.25 inches wide by 0.5 inches long. Closed ended slots 68 and 69 are formed in wings 65 and 66. Four holes such as 70 are bored through plate 64. Two bolts such as 72 pass through holes 73 in each of switches 16 and 17 and through holes 70 in plate 64 and together with nuts, such as 75, fasten the switches 16 and 17 to the plate 64. Screws 77 and 78 pass through slots 68 and 69 into threaded bores 53 and 54 to hold plate 64 to housing body portion 37. Switch male terminals, such as 80, are connected to push-on female terminals, such as 81, which are crimped on wires, such as 82, which pass through a flexible collar 83 and bore 60. Preferably the units are manufactured without the wires and the push on female terminals are crimped onto the wires and then slipped over the male terminals at the time of installation.

Housing cover 38 is of a size and shape to fit over and close the open end of housing body 37 and has a lip 85 about 0.125 inches high about its circumference, the lip having lands, such as 87, in each corner and holes, such as 89, passing entirely through cover 38 in each of the lands. Cover 38 also includes the molded-in posts 91 and 92 about 0.215 inches high which lie as a line passing through plungers 26 and 27. Posts 91 and 92 each have threaded bores 93 and 94 which are about as deep as the posts are high. Cover 37 also includes a rectangular bracket 95 about 0.705 inches high by 0.7 inches wide by 0.187 inches thick having a semicircular indentation 96 about 0.236 inches in radius. Bracket 95 is formed tomate with flange 56 lower portion 58 to form in a circular strain relief which clamps collar 83 to hold the wires, such as 82, firmly. Screws, such as 99, pass through holes 89 in cover 38 and screw into bores 41 in body 37. Gasket 97 is formed to conform to the mating surfaces of lip 85 and body portion 37 and seals their juncture. The above description applies to both the switch 10 configured in the linearly actuated mode and switch 22 configured in the swing actuated mode.

Figure 9:
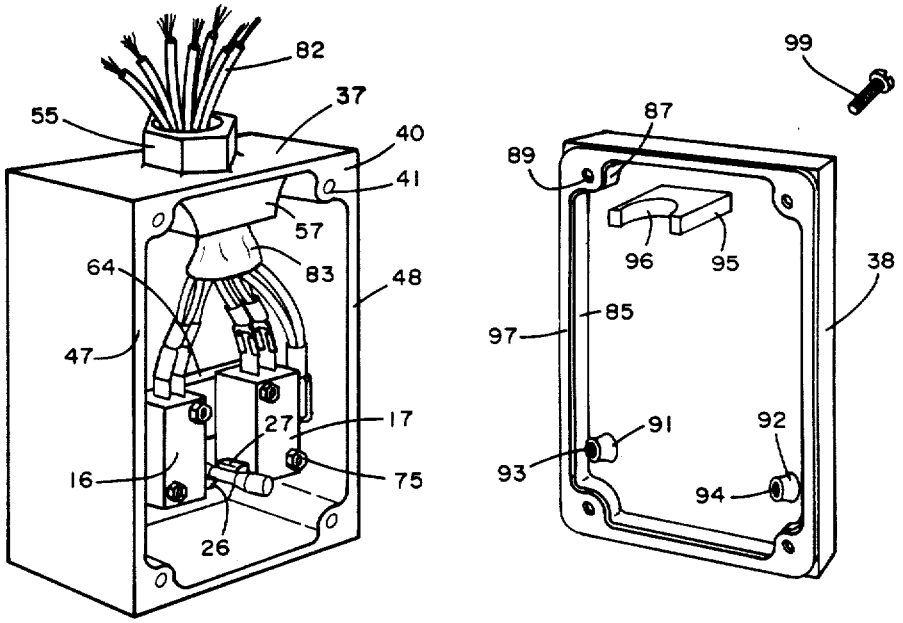
FIG. 9 is a perspective view of the linearly actuated switch of FIG. 6 with the cover opened.
Figure 10:
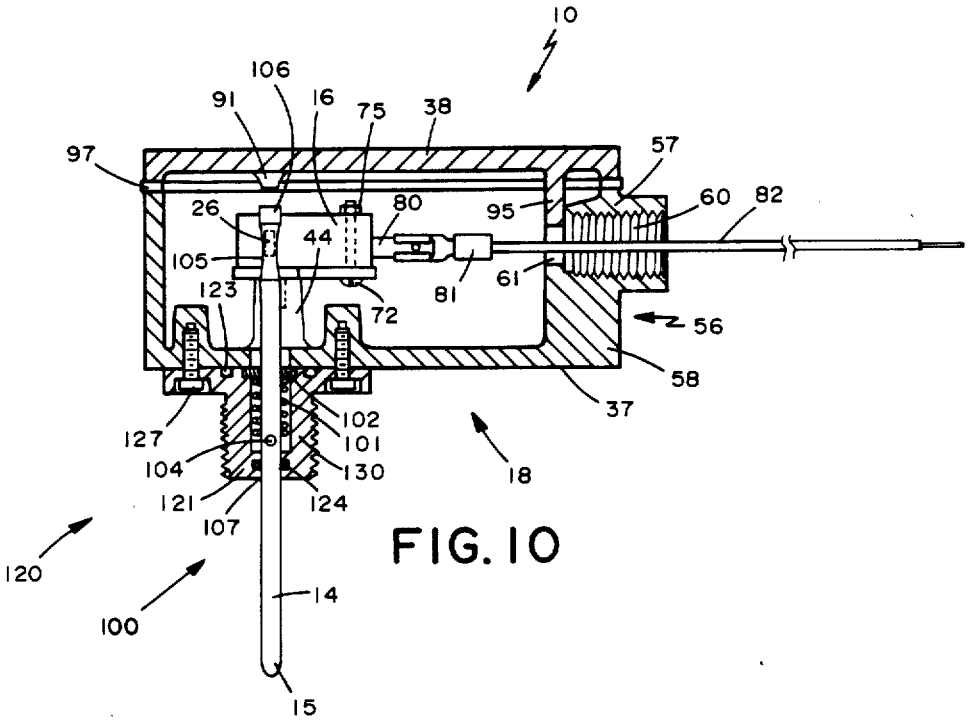
FIG. 10 is a cross-sectional view of the linearly actuated switch taken in the plane of FIG. 6 through the mid-line of the switch.
Figure 11:
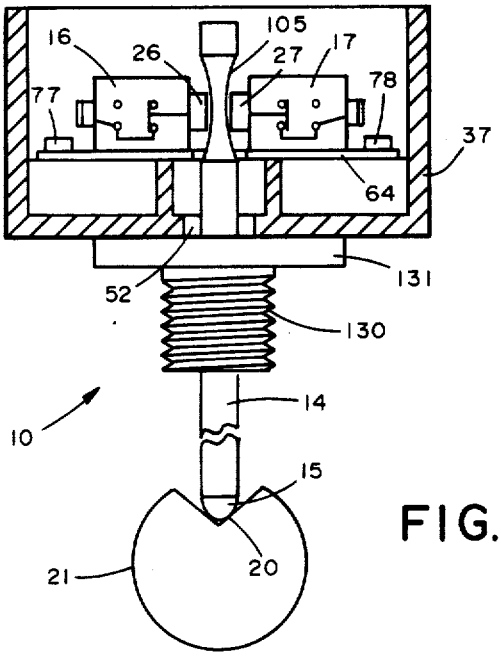
FIG. 11 is a cross-sectional view of the linearly actuated switch with the cover removed taken through the mid-points of the switch plungers.

Directing attention now to FIGS. 9, 10 and 11, we turn to the description of the linear actuator means 100. Linear actuator means 100 preferably comprises a linear actuator member 14 and a bias means which preferably comprises spring 101, pin 104 and retaining washer 102. Preferably the actuator member 14 is a rod about 4.25 inches long and 0.25 inches in diameter having a waist portion 105 starting about 0.25 inches from the proximal end which is radiused down to about 0.125 inches in diameter and having a rounded distal end 15. Pin 104 is about 0.125 inches in diameter and 0.375 inches long and passes through rod and extends equidistantly from it on either side at a point about 2 inches from the proximal end 106. Spring 101 is a coil springabout 0.029 inches in diameter with a free length of about 0.6875 inches and a spring rate of about 8.6 lbs./inch. Spring retaining washer 102 is about 0.5 inches in diameter and about 0.062 inches thick. Rod 14 is supported by a means 107 for supporting it while permitting it tomove linearly which comprises the inner bore 134 of sleeve 130.

Figure 7:
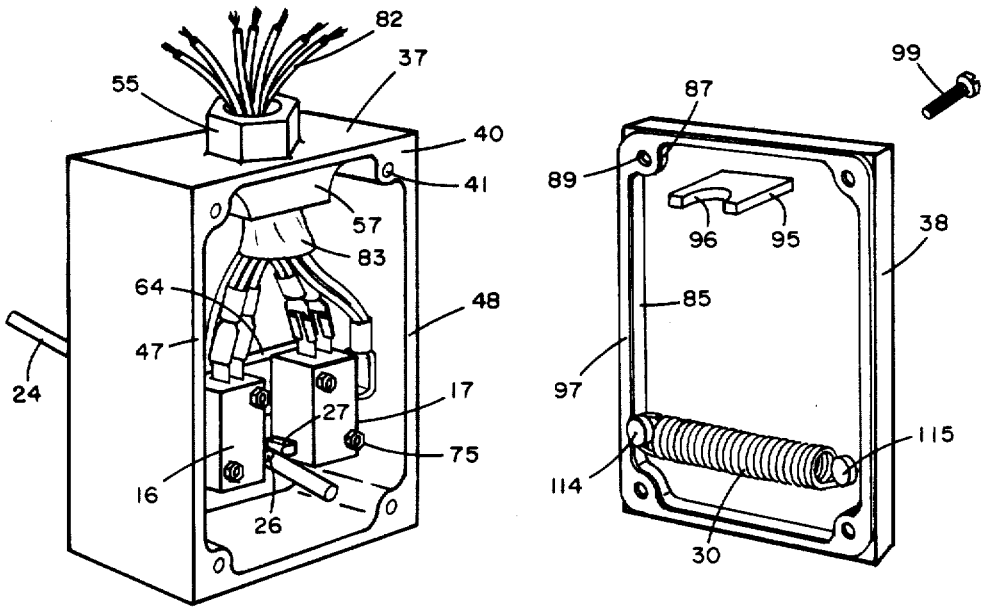
FIG. 7 is a perspective view of the swing actuated switch of FIG. 5 with the cover opened.
Figure 8:
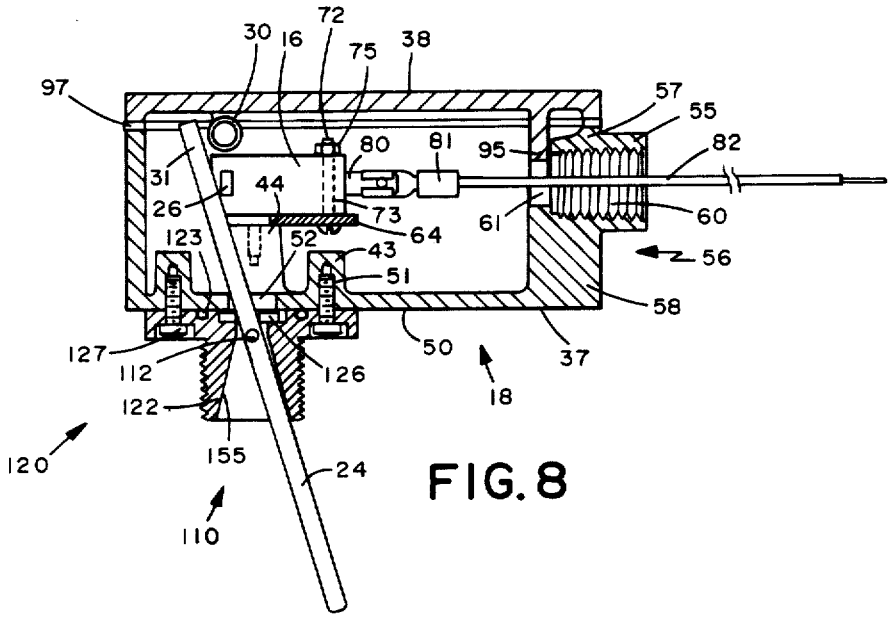
FIG. 8 is a cross-sectional view of the swing actuated switch taken in the plane of FIG. 5 through the mid-line of the switch.
Figure 12:
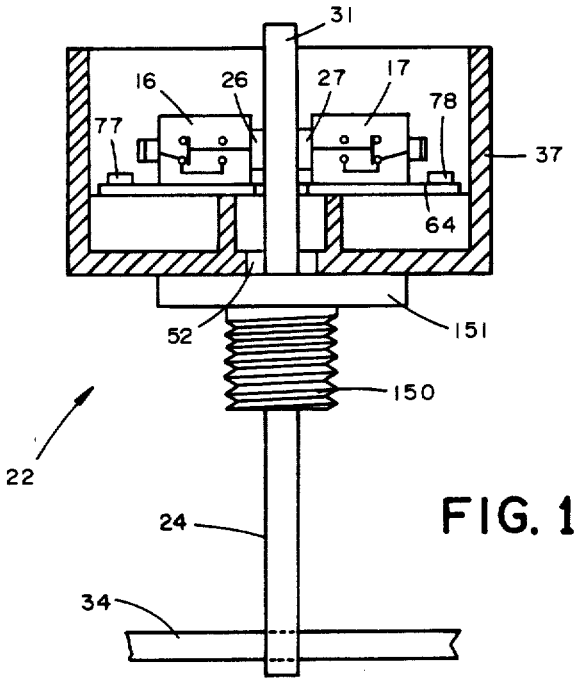
FIG. 12 is a cross-sectional view of the swing actuated switch with the cover removed taken through the mid-points of the switch plungers.
Figure 13:
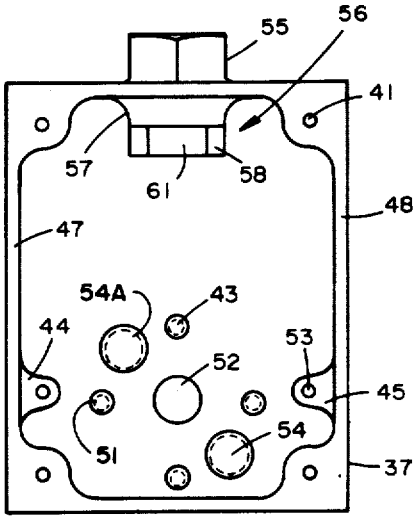
FIG. 13 is a plan view of the supervisory switch housing body according to the inventio looking into the open end ofthe housing body.
Figure 14:
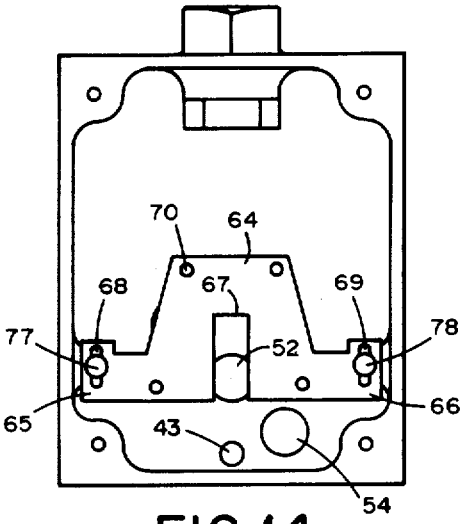
FIG. 14 is a plan view of the supervisory switch housing body according to the invention with the switch plate attached.
Figure 15:
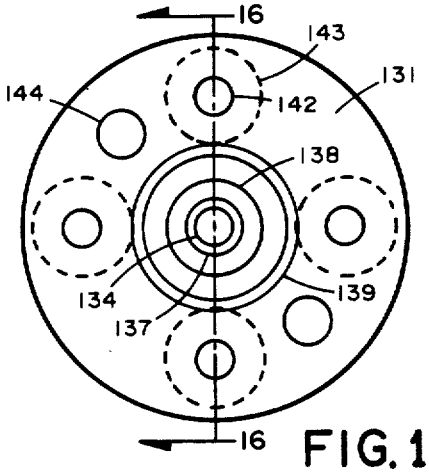
FIG. 15 is an end view of the supervisory switch actuator retainer according to the invention for the linear actuated configuration.
Figure 16:
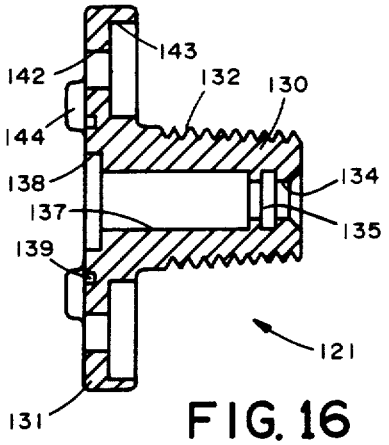
FIG. 16 is a cross-sectional view of the retainer of FIG. 15 taken through line 16—16 of FIG. 15.

Directing attention to FIGS. 7, 8 and 12, swing actuator means 110 preferably comprises swing actuator member 24 and a bias means preferably comprising spring 30, and screws 114 and 115 and posts 91 and 92. Preferably swing actuator member 24 comprises a rod 24 about 5.5 inches long and 0.25 inches in diameter. Means 112 for pivotably supporting the swing actuator member 24 comprises a pin 112 about 0.125 inches in diameter and 0.375 inches long passing through the rod and extending equidistantly from its sides at a point about 2 inches from the proximal end 31. Spring 30 is preferably a coil extension spring of about 0.375 inches outside diameter a free length of about 2 inches and a spring rate of about 13.1 lbs./inc. Screws 114 and 115 are preferably #6-32×⅜ AV safe screws or other similar screws.

Figure 17:
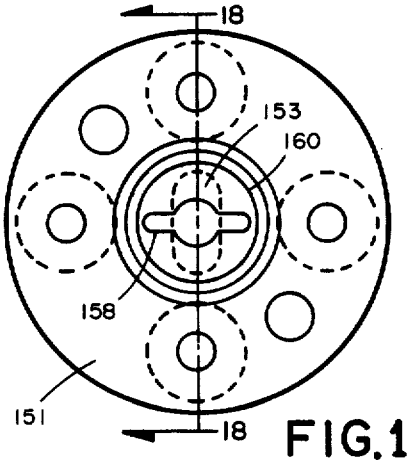
FIG. 17 is an end view of the supervisory switch actuator retainer according to the invention for the swing actuated configuration.
Figure 18:
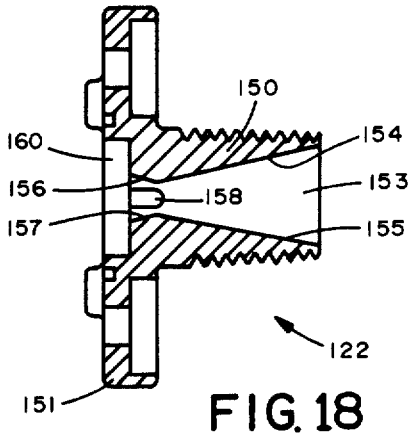
FIG. 18 is a cross-sectional view of the retainer of FIG. 17 taken through line 18—18 of FIG. 17.

Turning now to FIGS. 8, 10, 15, 16, 17 and 18, coupling means 120 comprises linear actuator retainer 121, swing actuator retainer 122, O-ring 123 and 124, sliding seal washer 126, four screws, such as 127, and four threaded bores, such as 51, in housing body 37. Linear actuator retainer 121 includes a cylindrical sleeve 130 and a circular flange 131. Sleeve 130 is about 1 inch long by 0.5 inches in outer diameter and threads 132 are formed in its outer surface. It has an inner bore 134 which is about 0.26 inches in diameter, an O-ring cavity 135 about 0.372 inches in diameter and about 0.076 inches wide, and a spring bore 137 about 0.375 inches in diameter and 0.69 inches long. Flange 131 includes a circular retainer bore 138 about 0.510 inches in diameter by 0.062 inches deep, a circular O-ring groove 139 of about 0.75 inside diameter and 0.875 outside diameter, four screw bores 142 of about 0.156 inches in diameter with counter sunk bores 143 about 0.375 inches in diameter and 0.125 inches deep. Two locating bosses 144 about 0.094 inches high and 0.24 inches in diameter are formed in the surface of flange 131. Swing actuator retainer 122 includes sleeve 150 and flange 151. Sleeve 122 has a flat-hour-glass shaped bore 153. The width of bore 153 is about .268 along its flat dimension in FIG. 17 and it flares from about a circular radius of 0.158 inches at the narrowest portion to a width of about 0.597 inches at its widest portion as shown at the right of FIG. 18 with an angular slope of about 20° between the opposing walls 154, 155, 156 and 157. A groove 158 is formed in sleeve 150 at the junction of bore 153 with the sliding seal bore 160. Each of the three closed ends of groove 158 is rounded with a radius of about 0.070 inches with the center of the radius in the plane of FIG. 18 sunk about 0.198 inches from the surface of flange 151 and the other two radii in the plane of FIG. 17 are separated by about 0.375 inches. The outside of sleeve 150 is also threaded with a 0.5 inch standard pipe thread. Flange 151 is formed similarly to flange 141 except that sliding seal bore 160 is about 0.629 inches in diameter by about 0.125 inches deep.

Turning back now to FIG. 2, switch 10 is mounted on valve assembly 170 by means of mounting assembly 170 which comprises slotted brackets 171 and 172, bolts 175 and 176, J-bolts 178 and 179, washers, such as 180, nuts, such as 181, and flat nuts 184 and 185. Bracket 171 has a hole 186 in its center of sufficient diameter to accept sleeve 130. Flat nuts 184 and 185 secure switch 10 to plate 171. The nuts, such as 181, on bolts 175 and 176 may be adjusted to adjust the height of switch 10 above valve stem 21. J-bolts 178 and 179 hook around the valve assembly supports, such as 190. Various valve assembly sizes and constructions may be fit by adjusting bolts 175 and 176, 178 and 179 in their respective slots, such as 191. The housing 18 and retainers 121 and 122 are preferably molded of an aluminum, silicon, copper alloy or other suitable corrosive-resistant material. Gasket 97 is preferably made of adhesive backed rubberized cork or other suitable gasket material. Springs 30 and 101, actuator members 14 and 24, and pins 104 and 112 are preferably made of stainless steel. Sliding seal 126 is preferably made of 40 duro neoprene. O-rings 123 and 124 are preferably made of neoprene or silicon rubber. Retaining washer 102 and the mounting assembly 170 parts are preferably made of zinc-plate stel. All other screws and bolts and nuts are preferably stainless steel or zinc-plated steel. Screws 77, 78, 99 and 127 are tamper resistant type with special heads which require special tools to engage. Wires 82 are preferably 20 AWG 600 V stranded. Plate 64 is aluminum or other suitable corrosive resistant material.

Figure 2:
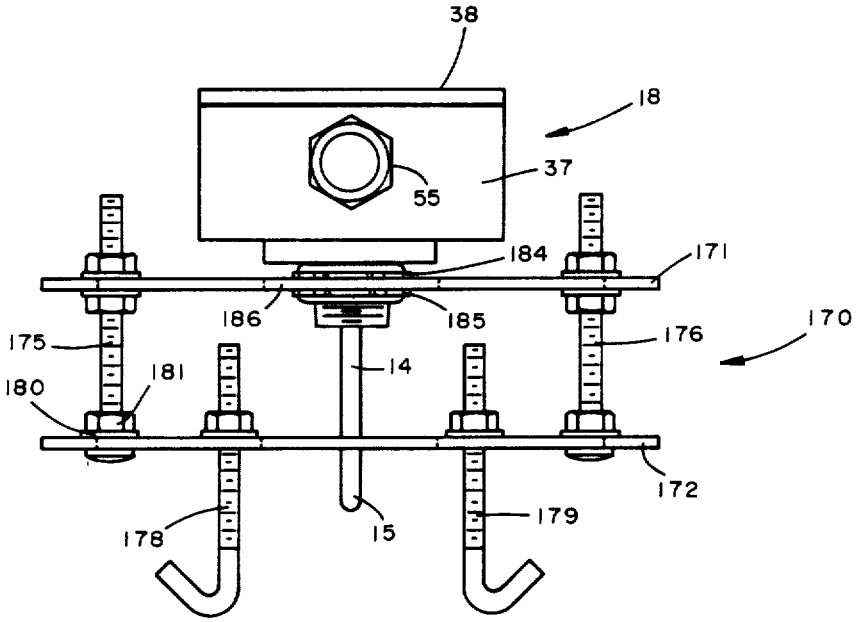
FIG. 2 is an end view of the supervisory switch of FIG. 1 attached to its mounting bracket.

The linear actuator switch configuration 18 operates as follows: The switch 18 is mounted on a gate valve assembly 12 using mounting assembly 170 as shown in FIGS. 1, 2 and 11 so that the distal end 15 of rod 14 rides in a detent 20 in the shaft 21 of the gate valve guided by plate 172 and the waist 105 of rod 14 lies between plungers 16 and 17. When the valve is operated the detent 20 moves out from under the rod 14 and the end 15 of the rod cams up onto the outside diameter of the shaft. In some instances if the valve assembly is such that it is necessary for the end 15 to ride on valve threads 13 and the threads are the coarse (Acme style) variety, a bull nose (not shown) may be added to end 15. The riding up of the shaft raises the rod and moves the thicker portion of rod 14 between plungers 26 and 27 which pushes them in. This opens one set of contacts and closes another set of contacts in each of switches 16 and 17. See FIG. 11. The movement of rod 15 also compresses spring 101 between pin 104 and retaining washer 102. When the valve stem 21 is returned to its original position, spring 101 forces rod end 15 back into detent 20 and the narrow waisted portion 105 of rod 14 returns to the position between plunger 26 and 27 and the switches 16 and 17 return to their original contact positions.

The swing actuator switch configuration 22 operates as follows: The switch is mounted on a post indicator valve either as shown in FIG. 3 for a flag falling type valve or as in FIG. 4 for a flag rising type valve. See discussion below for the difference in mounting for each case. The mounting is generally done by boring a threaded hole in the side of the valve housing and screwing in the threaded sleeve 150. In either case, the mounting is done so that the rod 24 lies between plungers 26 and 27 as shown in FIG. 12. In this position the proximal end 31 of the rod 24 will be forced against spring 30 stretching it. When the flag falls (FIG. 3) or rises (FIG. 4) and the spring 30 forces the rod to move away from its position between the switch plungers 26 and 27, the plungers extend, and one set of contacts opens and another closes within switches 16 and 17. When the valve is returned to its original position the flags move rod 24 back to its original position between the plungers 26 and 27 and the switches return to their original contact positions. It is understood that the above-discussed operations are exemplary only and other interactions between the actuators and switches are possible.

It is a feature of the invention that the swing configured switch 22 can be easily adjusted for either the flag falling or flag rising valve. Referring to FIG. 8, the position of the proximal end 31 of rod 24 is to the left of spring 30. This is the preferred arrangement that is appropriate for the mounting shown in FIG. 3. If the cover 38 is removed, the rod 24 is moved to the opposite travel limit along inner wall 155 of sleeve 122, and the cover is then replaced, the proximal end 31 of rod 24 will then act against the spring 30 from the opposite direction along its arc which is the appropriate arrangement for the mounting of FIG. 4.

Another feature of the invention is that the trip point for the switch in either configuration can be adjusted. This is done by loosening screws 77 and 78 (FIG. 14), adjusting the position of plate 64, and retightening the screws. This adjusts the position of plungers 26 and 27 relative to the position of rod 14 or 24 and thus changes the trip point of the rod.

A further feature of the invention is that the switch is sealed by O-rings 123 and 124, sliding seal 126 and gasket 97. Sliding seal 126, which in the preferred embodiment is a washer, fits snugly about rod 24 but is about 0.1 inches smaller in outside diameter than the bore 160 in which it is contained and thus it is free to slide within the bore as rod 24 pivots on pin 112. O-ring 124 acts as a wiper seal to prevent dirt and moisture from entering as linear actuator rod 14 slides.

Another feature of the invention are the bosses 144 which fit into detents 54 in housing body 37 and insure that the swing actuator member 111 can only be coupled so that it swings in a plane parallel to the longitudinal axis of the switch so that its arc is tranverse to spring 30.

The cover bracket 95 and the upper flange portion 57 and lower flange portion 58 of housing body 37 cooperate to form an integral strain relief for wires 82. When cover 38 is off, the wires 82 are free to move within the housing 18. When the cover 38 is put in place collar 83 of the wires 82 within it are clamped between the semicircular cover indent surface 96 and semicircular bore 61 on lower flange portion 58 to provide the strain relief.

A novel valve supervisory switch that can easily be configured and adjusted to fit a wide variety of valves and installation situations has been described. The description has been in terms of an exemplary embodiment and it is understood that different dimensions and materials may be used. It is also evident that those skilled in the art may now make many uses of and modifications of the specific embodiment described without departing from the inventive concepts. Consequently, the invention is to be construed as embracing each and every novel feature and novel combination of features present on the valve supervisory switch described.

What is claimed is:

1. A valve supervisory switch for supervising a valve having a movable portion, said supervisory switch comprising:

a housing having a port;

a switch within said housing, said switch including a switch actuating means;

a swing actuator member;

pivot means for pivotable supporting said swing actuator member;

a linear actuator member;

means for supporting said linear actuator member while permitting it to move linearly;

coupling means for permitting coupling of said swing actuator member to said housing with said swing actuator member extending through said port and engagable with said switch actuating means for actuating said switch and for permitting coupling of said linear actuator member to said housing with said linear actuator member extending through said port and engagable with said switch actuating means for actuating said switch; and means for attaching said housing to said valve with one of said actuator members coupled to said housing by said coupling means and actuable by said movable portion of the valve.

2. A supervisory switch as in claim 1 wherein said swing actuator member is movable about an arc when coupled to said housing and said supervisory switch further comprising means for changing the trip point of said switch along said arc.

3. A supervisory switch as in claim 2 wherein said means for changing the trip point of said switch comprises means for changing the position of said switch along said arc.

4. A supervisory switch as in claim 1 wherein said swing actuator member is pivotable about an arc when coupled to said housing and further including a resilient means attached to said housing in a direction traverse to and intersecting said arc.

5. A supervisory switch as in claim 4 and further including, means for permitting sadi swing actuator member to engage said resilient means from either direction along said arc.

6. A supervisory switch as in claim 5 wherein means for permitting said swing actuator member to engage said resilient means from either direction comprises a removable cover portion of said housing, and said resilient means is attached to said cover portion.

7. A valve supervisory switch for supervising a valve having a movable portion, said supervisory switch comprising;

a switch having a switch actuating means;

a swing actuator member;

a resilient member;

a pivot means for pivotably supporting said swing actuator member so that said swing actuator trips said switch actuating means along the arc through which it pivots and engages said resilient member along said arc;

means for changing the direction along said arc in which said swing actuator member engages said resilient member; and means for supportably attaching said switch, said swing actuator member, said pivot means and said resilient member to a valve assembly with said actuator member actuatable by said movable portion of the valve.

8. A valve supervisory switch for supervising a valve having a movable portion, said supervisory switch comprising:

a switch having a switch actuating means;

a switch actuator member;

a pivot means for pivotably supporting said swing actuator so that said swing actuator trips said switch actuating means as it moves along the arc through which it pivots;

resilient means for applying a bias force to said swing actuator member in a direction along said arc;

means for changing the direction of said bias force on said swing actuator member; and means for supportably attaching said switch, said swing actuator member, said resilient means and said pivot means to said valve assembly with said actuator member engaging actuable by said movable portion of said valve.

* * * * *

UNITED STATES PATENT AND TRADEMARK OFFICE

CERTIFICATE OF CORRECTION

PATENT NO. : 4,695,686

DATED : September 22, 1987

INVENTOR(S) : David E. Merchant

It is certified that error appears in the above-identified patent and that said Letters Patent is hereby corrected as shown below: IN THE SPECIFICATION:

Column 1, line 40, "required" should be -- require --;

Column 1, line 63, "," should be -- ; --;

Column 2, line 3, "tot he" should be -- to the --;

Column 2, line 14, "," should be -- ; --;

Column 2, line 17, "alng" should be -- along --;

Column 2, line 18, "throug" should be -- through -- and "redsilient" should be -- resilient --;

Column 2, line 33, "inventin" should be -- invention --;

Column 2, line 67, "inventio" should be -- invention --;

Column 2, line 68, "ofthe" should be -- of the --;

Column 3, line 19, "an" should be -- a --;

Column 3, line 31, "inventio" should be -- invention --;

Column 3, line 38, "actuation" should be -- actuator --;

Column 3, line 39, "betwen" should be -- between --;

Column 3, line 56, "fromone" should be -- from one --;

Column 3, line 61, "intot he" should be -- into the --;

Column 4, line 42, after "thick" insert -- and --;

UNITED STATES PATENT AND TRADEMARK OFFICE

CERTIFICATE OF CORRECTION

PATENT NO. : 4,695,686

DATED : September 22, 1987

INVENTOR(S) : David E. Merchant

It is certified that error appears in the above-identified patent and that said Letters Patent is hereby corrected as shown below:

Column 4, line 44, "tomate" should be -- to mate -- and after "form" delete "in";

Column 4, line 66, "springabout" should be -- spring about --;

Column 5, line 3, "tomove" should be -- to move --;

Column 5, line 19, "lbs./inc." should be -- lbs./in. --

Column 5, line 24, "0-ring" should be -- 0-rings --;

Column 5, line 59, "141" should be -- 131 --;

Column 6, line 17, "stel" should be -- steel --;

IN THE CLAIMS:

Column 7, line 67, "pivotable" should be -- pivotably --;

Column 8, line 33, "sadi" should be -- said --; and
Column 10, line 3, delete "engaging".

Signed and Sealed this

Twenty-eighth Day of June, 1988

*Attest:*

*Attesting Officer*

DONALD J. QUIGG

*Commissioner of Patents and Trademarks*